US007475552B2

(12) United States Patent
Sorsby

(10) Patent No.: US 7,475,552 B2
(45) Date of Patent: Jan. 13, 2009

(54) RECONDENSING SERVICE NECK FOR CRYOSTAT

(75) Inventor: Patrick Graham Sorsby, Cassington (GB)

(73) Assignee: Siemens Magnet Technology Ltd., Witney (GB)

( * ) Notice: Subject to any disclaimer, the term of this patent is extended or adjusted under 35 U.S.C. 154(b) by 358 days.

(21) Appl. No.: 11/346,344

(22) Filed: Feb. 3, 2006

(65) Prior Publication Data

US 2006/0207265 A1 Sep. 21, 2006

(30) Foreign Application Priority Data

Feb. 5, 2005 (GB) ..... 0502458.3

(51) Int. Cl.
*F17C 5/02* (2006.01)
*F25B 19/00* (2006.01)

(52) U.S. Cl. ..... 62/47.1; 62/51.1

(58) Field of Classification Search ..... 62/47.1, 62/51.1

See application file for complete search history.

(56) References Cited

U.S. PATENT DOCUMENTS

| | | | | | |
|---|---|---|---|---|---|
| 2,928,659 | A * | 3/1960 | Kinney | 165/110 |
| 4,277,949 | A * | 7/1981 | Longsworth | 62/47.1 |
| 4,279,127 | A * | 7/1981 | Longsworth | 62/77 |
| 4,606,201 | A * | 8/1986 | Longsworth | 62/51.2 |
| 5,144,810 | A * | 9/1992 | Nagao et al. | 62/47.1 |
| 5,339,650 | A * | 8/1994 | Hakamada et al. | 62/51.1 |
| 5,586,437 | A * | 12/1996 | Blecher et al. | 62/47.1 |
| 5,701,744 | A * | 12/1997 | Eckels et al. | 62/47.1 |
| 2004/0194473 | A1 * | 10/2004 | Daniels | 62/6 |

FOREIGN PATENT DOCUMENTS

| | | | |
|---|---|---|---|
| CA | 1133382 | A2 | 5/1981 |
| EP | 0304860 | A2 | 8/1988 |

* cited by examiner

*Primary Examiner*—William C Doerrler
(74) *Attorney, Agent, or Firm*—Crowell & Moring LLP

(57) ABSTRACT

The present invention provides a recondensing service neck for a cryostat. A service neck tube (22) provides access to the interior (10) of the cryostat. A recondensing surface is provided (44) for recondensing liquid cryogen boiled off from a liquid cryogen (12) within a cryostat; and a recondensing refrigerator (30) is provided for cooling the recondensing surface to below the boiling point of the cryogen.

6 Claims, 2 Drawing Sheets

RECONDENSING SERVICE NECK FOR CRYOSTAT

Figure 1:
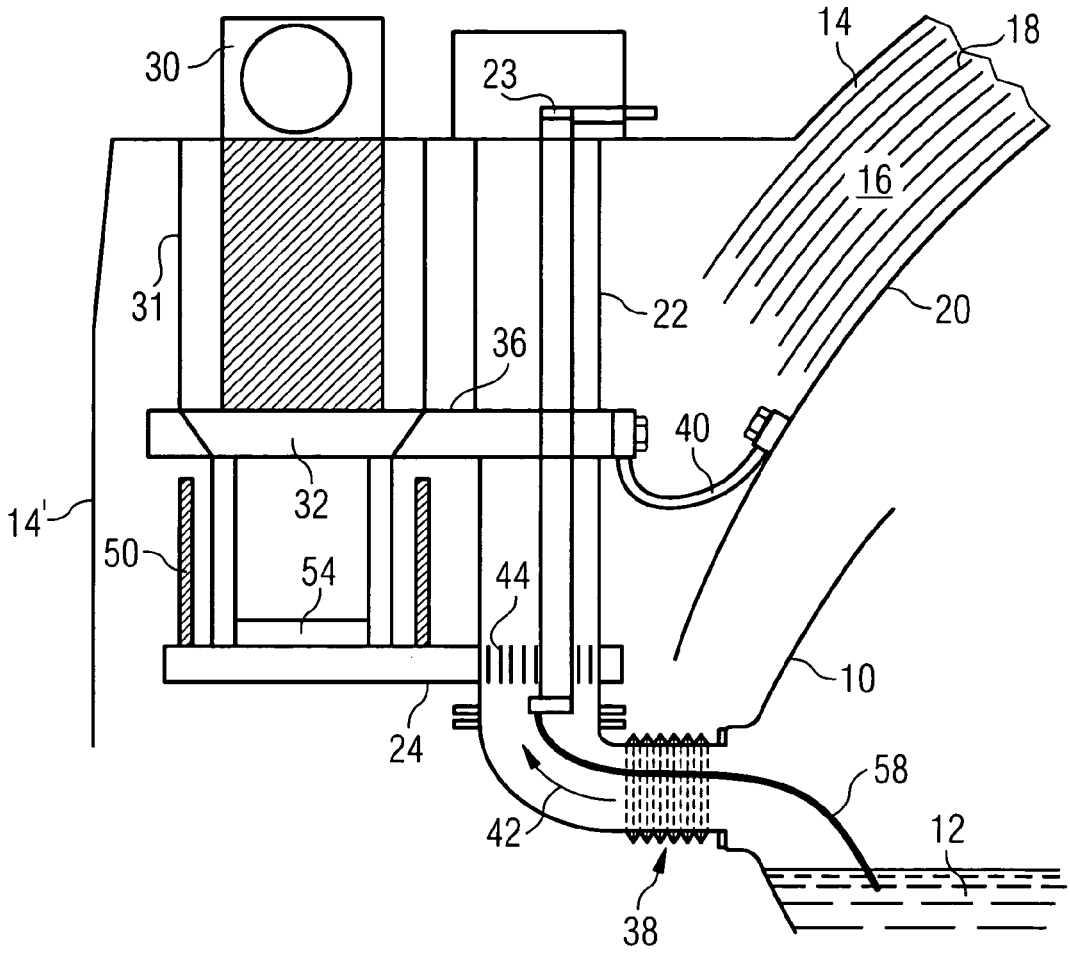

The present invention relates to service necks for cryostats containing liquid cryogen. In particular, the present invention provides a recondensing service neck comprising a refrigerator used to recondense cryogen gas (known hereafter as a recondensing refrigerator) in association with the service neck.

Known cryostats containing liquid cryogen, for example as used to house superconducting magnets for MRI or NMR imaging systems, typically comprise a service neck, housed in a service turret located towards the top of the cryostat, allowing current leads to pass into the cryostat; allowing access for filling with liquid cryogen, and allowing an exit path for boiled-off cryogen. The cryostat is typically also provided with a recondensing refrigerator, provided to reduce or eliminate consumption of cryogen due to boil-off, by recondensing boiled off cryogen back into its liquid state. Typically, the service neck is located in its turret at or near the top of the cryostat, while the recondensing refrigerator is located in a housing sock (also known as a sleeve) in a second turret near the top or at the side of the cryostat.

The provision of the service neck in a turret near the top of the cryostat provides the following problems. Access to the service neck is periodically required for servicing the cryostat and any equipment located inside the cryostat. Access is also required for refilling the liquid cryogen vessel in case of a reduction in liquid cryogen volume due to boil-off. Such access is rendered difficult if the service neck is located at the top of a very large piece of equipment. In applications such as MRI or NMR imaging systems, the environment in which the cryostat is installed may have very restricted height, meaning that the presence of service necks on the top of the equipment may reduce the height available for the remainder of the equipment. Again, due to the environment in which such systems are used, it is normal to provide "looks" covers over the functional part of the equipment, to be more suited to a clinical environment within sight of patients. The necessity of accommodating the service necks within the looks covers detracts from the aesthetic value of the resulting structure, while making the manufacture, installation, and removal of such covers more difficult.

The provision of a recondensing refrigerator at the top of the cryostat gives rise to problems such as those just described for the service neck being placed at the top of the structure.

The provision of separate turrets for housing each of the service neck and the recondenser refrigerator provides the following problems. Two access points into the liquid cryogen vessel must be provided. This leads to a relatively complex and costly manufacturing process, with risks of leaks through imperfect welds and additional heat loads to the liquid cryogen vessel. It would be advantageous to reduce the number of access points into the liquid cryogen vessel. In such structures, the recondensing refrigerator is placed some distance away from the service neck, and may be ineffective at cooling the service neck, leading to higher heat loads to the liquid cryogen vessel and hence greater boil-off.

The present invention addresses at least some of these problems and provides a combined service neck and recondenser refrigerator.

European Patent 0 905 524 of Siemens Magnet Technology Ltd describes a combined service neck and recondensing refrigerator, in which a pulse tube refrigerator is used, the pulse tube refrigerator being of annular form surrounding the neck tube. The present invention proposes an arrangement whereby a general refrigerator may be combined with a service neck, within a single access turret.

UK Patent Application GB 2 395 545 also provides a combined service neck and pulse tube refrigerator.

Figure 2:
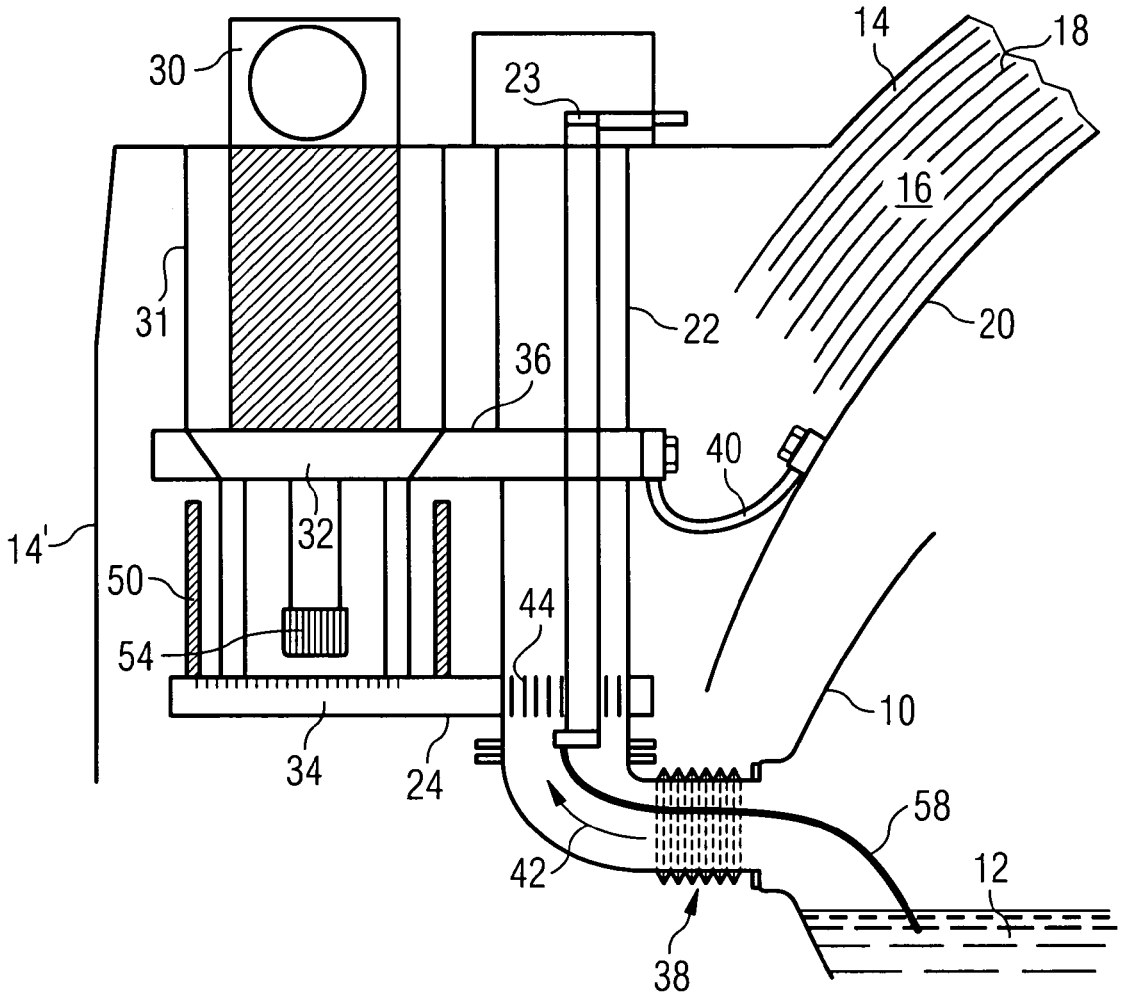

The above, and further, objects, characteristics and advantages of the present invention will become more apparent from consideration of the following description of certain embodiments thereof, in conjunction with the accompanying drawing, wherein:

FIG. 1 shows a cross-section of a combined service neck and recondenser according to an embodiment of the present invention; and FIG. 2 shows another embodiment of a combined service neck and recondenser according to the present invention, which employs a dual-recondensing refrigerator.

Referring to FIG. 1, the cryostat includes a liquid cryogen vessel 10 containing a liquid cryogen 12. An outer vacuum chamber 14 is provided, which encloses the liquid cryogen vessel 10. A vacuum is pulled in the space 16 between the liquid cryogen vessel 10 and the outer vacuum chamber 14. Solid thermal insulation such as metallised polyester film 18, commonly referred to as "superinsulation" may be placed within the space 16. A thermal shield 20 may be placed within the space 16, between the liquid cryogen vessel 10 and the outer vacuum chamber 14. This thermal shield serves to protect the liquid cryogen vessel 10 from heat radiated from the outer vacuum chamber, which is typically at room temperature—about 300K. The liquid cryogen 12 may be liquid helium, which is held at a temperature of about 4K.

As in known systems, a service neck 22 is provided, allowing access to the liquid cryogen vessel 10 for services such as an electrical connector, commonly known as a positive tube, 23. This access may be via a bellows arrangement 38. Positive tube 23 carries electrical power into the cryostat, for example for introducing current into superconducting magnet coils held at superconducting temperature by the liquid cryogen 12 within the cryogen vessel 10. An electrical cable 58 is typically provided for connecting the positive tube 23 to the coils. The return electrical path is typically provided through the structure of the cryostat. This service neck is preferably placed towards the side of the outer vacuum chamber 14, away from the top which is the usual position for the service neck.

According to a feature of the present invention, a part 44 of the service neck 22 is thermally linked by a heat exchanger 24 to a cooling stage 54 of a refrigerator 30. The refrigerator 30 is preferably housed within a sock 31 (also known as a sleeve). This allows the refrigerator to be removed for servicing or replacement without breaking the vacuum in region 16. The sleeve is preferably evacuated to eliminate the possibility of thermal influx by gas convection within the sock. Since the refrigerator is removable from the sock, effective but removable thermal links must be made between the heat stations 32, 54 of the refrigerator and the heat exchangers 36, 24 leading from the sock. Examples of such thermal links are well known to those skilled in the art and include close mechanical fits, indium washers and so forth. In the embodiment shown in the drawings, the recondensing refrigerator 30 is a two-stage refrigerator. Such refrigerators typically cool a first cooling stage 32 to approximately 50K, and cool the second cooling stage 54 to approximately 4K.

The sock 31 and the service neck 22 are preferably formed from thin walled tubes vacuum brazed to copper parts. The tubes should be of a material of great structural strength, but relatively low thermal conductivity, such as stainless steel.

As shown in FIG. 1, according to an embodiment of the invention, cooling stage 54 is thermally connected 24 to the service neck 22. The cooling stage is preferably also thermally connected to, but electrically isolated from, the positive tube 23. The cooling stage 32 may also be connected to the thermal shield 20, for example by a flexible thermal link 40 such as copper braid or a metal laminate. Preferably, and as shown, the refrigerator and service neck are located within a single turret 14' on the side of the cryostat.

In operation, liquid cryogen 12 is boiled by heat influx from ambient, together with any heat generated within the cryostat, for example by electricity flowing in resistive conductors. An appreciable proportion of the heat influx arrives through the material of the service neck 22 and its associated services such as positive tube 23. The boiled off cryogen attempts to leave the cryostat by flowing along exit path 42 into the service neck 22. According to an aspect of the present invention, a part 44 of the service neck is cooled by refrigerator 30 to below the boiling point of the cryogen 12. Cooling power is transferred directly to the service neck through the thermal path 24, for example a continuous piece of copper, which is preferably exposed inside the service neck to form a recondensing surface. The cooling stage is preferably also thermally connected to, but electrically isolated from, the positive tube 23. The boiled-off cryogen vapour from the liquid cryogen vessel 10 recondenses on the surface of the cooled part 44 of the service neck 42, and flows back into the liquid cryogen vessel 10. The direct thermal connection 24 between the refrigerator 30 and the service neck 22 creates a very effective recondensing surface inside the service neck. This thermal link also serves to intercept any heat influx travelling along the walls of the service neck and services, such as the positive tube 23. Such heat influx typically accounts for one-third of the total heat load into such systems.

In preferred embodiments of the present invention, the thermal path 24 between the refrigerator and the service neck is preferably constructed of a plate of copper or other material of high thermal conductivity. This plate is preferably exposed to the interior of the service neck. More preferably, the surface of the plate 24 which is exposed to the interior of the service neck is ribbed to increase the surface area available for recondensation. This ribbing preferably consists of numerous vertical grooves in the plate 24 to assist the recondensed liquid cryogen to drip back into the liquid cryogen vessel 10.

In embodiments employing a two-stage refrigerator, such as illustrated in FIG. 1, the first stage 32 of the refrigerator is preferably thermally linked 36 to an upper part of the service neck 22 in addition to the thermal connection of the second stage 54 of the refrigerator to the recondensing surface 44 as discussed above. A thermal path 36 is provided between the first stage of the refrigerator and the upper part of the service neck, and is preferably constructed of a plate of copper, or copper braid, or other material of high thermal conductivity. The first cooling stage is preferably also thermally connected to, but electrically isolated from, the positive tube 23. It is otherwise not necessary to expose this thermal path 36 to the interior of the service neck, nor to provide a ribbed surface, since recondensation will not occur here. An advantage in cooling the upper part of the service neck in this way is to prevent the ingress of heat from ambient along the material of the access turret 22. This in turn will lead to more effective recondensation of the boiled-off cryogen at part 44.

When the cryostat is used to house a magnet for an MRI or NMR imaging system, the oscillation of magnetic material within refrigerator 30 may produce interference in the magnetic imaging field. An electromagnetic shield 50 is preferably provided around the second stage of the refrigerator 30, to reduce such interference.

FIG. 2 illustrates another embodiment of the present invention, wherein the refrigerator 30 is thermally linked to heat path 24 by a recondensing interface. Such a recondensing interface is itself described in United Kingdom patent application 0423895.2.

The refrigerator sock 31 is isolated from the main cryogen vessel 10. In the embodiment of FIG. 2, the sock 31 is filled with a cryogen such as helium. The sock may be evacuated during cryostat transit when the refrigerator is not operational, to reduce the heat load conducted into the cryogen vessel 10. The refrigerator 30 is provided with a cold stage heat exchanger 54 which is exposed to the cryogen in the sock. In operation, the gaseous cryogen in the sock recondenses on the heat exchanger 54 back into its liquid state. The liquid cryogen drips on to the heat path 24 in region 34. The region 34 of the heat path 24 may be finned or otherwise machined or prepared so as to increase the surface area for heat transfer, yet still allowing the free flow of liquid across the surface. The heat path is cooled to the temperature of the liquid cryogen. Heat is drawn away from the service neck 22, cooling the exposed surface 44 inside the service neck to the temperature of liquid cryogen. This causes condensation of boiled off cryogen from the liquid cryogen vessel 10 on the surface 44 inside the service neck 22. This condensation releases latent heat to the thermal path 24. This heat travels along the thermal path and results in the boiling of the liquid cryogen in the sock/sleeve. The refrigerator 30 cools this boiled-off cryogen in turn, resulting in an efficient removal of heat from the boiled off cryogen in the cryogen vessel 10. As the boiled off cryogen in the service neck condenses to liquid, the pressure of the boiled off cryogen in this volume reduces, drawing further cryogen vapour into the service neck, to be recondensed.

The interface is arranged such that the cryogen in sock 31 has a lower boiling point than the cryogen in the vessel 10. This is in order that the thermal path 24, cooled to the boiling point of the cryogen in the sock 31, is cold enough to cause recondensation on the surface 44. This may be achieved by maintaining a lower gas pressure in the sock 31 than the gas pressure in the vessel 10.

The present invention accordingly provides an improved service neck for a cryostat. The present invention provides advantages in terms of cryogenic performance, serviceability, material cost, manufacturing time, improved aesthetics, for example as described below.

Only a single access point is required into the liquid cryogen vessel. This reduces manufacturing time and reduces the risk of leaks through defective welds, as compared to a system in which two or more access points are required. The service neck and the recondensing refrigerator share a single turret, meaning simplified manufacture of the outer vacuum chamber 14, together with reduced material costs. The service neck turret and refrigerator sock assemblies are substantially merged, leading to savings in terms of space and material cost. Fewer cuts are also required in the insulation 18, and in the thermal shield 20.

Since the recondensing refrigerator and the service turret may be located on the side of the cryostat, they may be placed at a lower height than in the case of known systems in which the service neck and/or recondenser refrigerator are located at the top of the cryostat. This allows the overall height of the system to be reduced, enabling stringent height restrictions to be met, and possibly also allows larger cryostats to be used within existing height restrictions. The side placement of the service neck and recondensing refrigerator allows all service functions to be performed on one side of the system without any need to reach the top of the system. The aesthetic appearance of the resultant system is improved, as outer "looks" covers will not have to accommodate bulky top service neck entry housing and venting, or the recondensing refrigerator at the top of the system.

By placing the single turret at the side of the cryostat, the boiled off cryogen gas 42 may be kept at a greater distance away from any superconducting coils housed within the cryostat, reducing the risk of quench induced by the heated cryogen gas as compared to prior art systems in which the turrets were housed at the top of the cryostat, directly above the coils.

Furthermore, by placing the single turret at the side of the cryostat, the length of tubes such as service neck 22, sock 31, positive tube 23 may be increased without increasing the overall height of the cryostat system. This may assist in reducing heat influx to the system, as compared to prior art systems in which the turrets were housed at the top of the cryostat.

Assembly of a recondensing service neck according to the present invention may proceed as follows. An access hole is made in the liquid cryogen vessel. Bellows 38 are welded in place over the access hole. The various services required, such as electrical cable 58, are threaded through the bellows. The bellows serve to accommodate any difference in thermal expansion of various parts, and to increase the thermal path length for heat ingress to the liquid cryogen vessel 10. An upper surface of the turret may be formed by deforming a part of the outer vacuum chamber 14. The assembly consisting of the service neck 22, the thermal links 36, 24 and the sock 31 is dropped through a hole provided in the upper surface of the turret, and appropriate connections are made between the services in the bellows and in the service neck. The service neck 22 is welded to the bellows, for example using an automatic pipe welder. Any remaining radiation shields, solid insulation 18 and plates 14' completing the outer vacuum chamber are connected to complete the assembly.

The present invention provides a recondensing refrigerator and service neck in a single turret. This has the advantage that fewer flexible thermal links are required to join the shield 20 to the service neck and recondensing refrigerator than would be the case in known systems having separate turrets for the refrigerator and for the service neck.

While the present invention has been described with reference to a limited number of specific embodiments, numerous modifications and variations are possible within the scope of the appended claims, as will be apparent to those skilled in the art.

For example, the refrigerator 30, typically housed within a sock (sleeve), may be placed more distant from the liquid cryogen vessel 10 than the service neck 22, as shown in FIG. 1, or their relative positions may be reversed.

The service neck and recondensing refrigerator turret assembly may be tilted away from the vertical if convenient for integration with the liquid cryogen vessel, for example in order to avoid violation of total system width limits. Tilting the turret assembly in such a manner will have cryogenic penalty, but this can be offset by increasing the overall length of the service neck, to resist thermal ingress along the service neck.

In certain embodiments of the present invention, a demountable positive tube 23 may be provided. This would give better thermal performance since thermal influx along the material of the current lead could be avoided by removing positive tube 23 while the magnet is in operation. A possible drawback of such an embodiment is that a demountable tube, by its very nature, cannot be permanently sealed, so that ice may form on the recondensing surface 44 when the positive tube is removed.

The invention claimed is:

1. A service neck and refrigerator assembly for a cryostat, comprising:

a service neck tube for providing access to the interior of the cryostat;

a recondensing surface for recondensing liquid cryogen boiled off from a liquid cryogen within a cryostat;

a refrigerator for cooling the recondensing surface to below the boiling point of the cryogen; and a thermal link provided between a cooling surface of the refrigerator and a part of the service neck tube; wherein an interior surface within said part of the service neck tube forms the recondensing surface; and a surface of the thermal link is exposed within the service neck tube, said exposed surface being the interior surface that forms recondensing surface.

2. A service neck and refrigerator assembly according to claim 1, wherein the recondensing surface is ribbed.

3. A service neck and refrigerator assembly according to claim 1, wherein:

the recondensing refrigerator is a two-stage refrigerator;

a first stage cooling surface of the recondensing refrigerator is thermally connected to an upper part of the service neck tube; and a second stage cooling surface is thermally connected to the thermal link.

4. A service neck and refrigerator assembly according to claim 1, wherein:

the cooling surface is thermally connected to the thermal link by a recondensing interface;

the recondensing interface itself comprises a closed recondensation chamber containing a cryogen exposed to the cooling surface of the refrigerator and also exposed to the thermal link, whereby heat may be transferred from the thermal link to the cooling surface by repeated evaporation and recondensation of the cryogen within the closed recondensation chamber.

5. A cryostat comprising a service neck and refrigerator assembly according to claim 1, housed within a single turret structure.

6. A cryostat according to claim 5 wherein the turret structure is located substantially on a side of the cryostat.

* * * * *